US010758092B2

(12) United States Patent
Whitaker

(10) Patent No.: US 10,758,092 B2
(45) Date of Patent: Sep. 1, 2020

(54) WATER BARRIER FOR SHOWER DOOR BOTTOM

(71) Applicant: Thomas M. Whitaker, Stratford, CT (US)

(72) Inventor: Thomas M. Whitaker, Stratford, CT (US)

(73) Assignee: Mr. Shower Door, Inc., Stratford, CT (US)

( * ) Notice: Subject to any disclaimer, the term of this patent is extended or adjusted under 35 U.S.C. 154(b) by 301 days.

(21) Appl. No.: 14/744,976

(22) Filed: Jun. 19, 2015

(65) Prior Publication Data

US 2016/0367082 A1 Dec. 22, 2016

(51) Int. Cl.
*A47K 3/36* (2006.01)
*A47K 3/30* (2006.01)

(52) U.S. Cl.
CPC ..... *A47K 3/36* (2013.01); *A47K 2003/305* (2013.01)

(58) Field of Classification Search
CPC ..... A47K 3/36; A47K 3/302; A47K 2003/305
USPC ..... 4/607
See application file for complete search history.

(56) References Cited

U.S. PATENT DOCUMENTS 294,267 A * 2/1884 Potter ..... E06B 7/2316 49/470
1,944,440 A * 1/1934 Lehman ..... A47K 3/36 4/607
2,140,453 A 12/1938 Horton et al.
2,428,731 A * 10/1947 Abrams ..... E06B 7/231 49/490.1
3,390,486 A * 7/1968 Walters ..... A47K 3/36 16/237
3,449,770 A * 6/1969 Casebolt ..... A47K 3/36 4/607
5,023,965 A * 6/1991 Reichel ..... A47K 3/36 4/557
5,469,665 A * 11/1995 Biebuyck ..... E06B 7/2316 49/470
6,035,460 A * 3/2000 Borter ..... A47K 3/36 4/605

(Continued)

FOREIGN PATENT DOCUMENTS

DE 8521682 U1 * 9/1985 ..... A47K 3/36
DE 29720597 U1 * 2/1998 ..... A47L 3/36

(Continued)

OTHER PUBLICATIONS

DE 29720597 U1 Translation.*

(Continued)

*Primary Examiner* — David P Angwin
*Assistant Examiner* — William R Klotz
(74) *Attorney, Agent, or Firm* — St. Onge Steward Johnston & Reens, LLC

(57) ABSTRACT

A water barrier assembly for a shower door, including first and second sidewalls, a bottom wall joining the first and second sidewalls, interior surfaces of the bottom wall and the first and second sidewalls defining a channel adapted to receive a bottom portion of a shower door, a deflector extending outward from a top portion of the first sidewall, and a flexible blade extending from a bottom surface of the deflector and adjacent to an exterior surface of the first sidewall terminating with a distal end beyond a bottom surface of the bottom wall.

17 Claims, 7 Drawing Sheets

(56) References Cited

U.S. PATENT DOCUMENTS

| | | | |
|---|---|---|---|
| 8,850,633 | B2 | 10/2014 | Erlebach |
| 2014/0230178 | A1 | 8/2014 | Bratec et al. |
| 2014/0259367 | A1 | 9/2014 | Taingtae et al. |

FOREIGN PATENT DOCUMENTS

| | | | |
|---|---|---|---|
| DE | 10207024 | A1 | 8/2003 |
| DE | 202004009706 | U1 | 11/2005 |
| EP | 2078482 | A2 | 7/2009 |
| GB | 2482109 | A | 1/2012 |

OTHER PUBLICATIONS

DE 8521682 U1 Translation.*

GoldRays Professional Sealing Materials. PVC Seal Vinyl Strip. 2009. Mar. 26, 2015. <http://www.showerdoorseal.org/pvc%20seal%20004.html>.

Roman at Home. Shower Door & Bath Screen Bottom Seal: 1000mm Straight. 2015. Mar. 26, 2015. <http://www.romanathome.com/bathroom/bathroom-accessories/bath-seals/shower-door-bath-screen-bottom-seal-1000mm-straight/>.

* cited by examiner

WATER BARRIER FOR SHOWER DOOR BOTTOM

FIELD OF THE INVENTION

The invention relates to shower door components and hardware, and more specifically to an improved water barrier mechanism for the underside of a shower door.

BACKGROUND OF THE INVENTION

Shower enclosures, including hinged shower doors, are known in the art and typically include a mechanism on the bottom side of the door to prevent or at least reduce water escaping out of the enclosed shower.

EP 2078482 discloses a shower screen with a water barrier beneath a lower edge. The water barrier includes a first barrier mounted to the floor and a second barrier, or tongue, mounted to a lower edge of the door and projecting downward. The second barrier is mounted towards the outside edge of the door and interacts with the first barrier to block water. Given the attachment position of the second barrier, its maximum length and ability to flex are limited.

DE 10207024 discloses another seal for a shower door. As shown in FIG. 1, this reference teaches the use of a sealing strip mounted on the threshold of the door. This design requires a significant raised element on the threshold that, in addition to be aesthetically displeasing, can be a hazard for people entering and exiting the shower.

What is desired is an improved water barrier mechanism which provides for greater flex and better water prevention.

SUMMARY OF THE INVENTION

Accordingly, it is an object of the present invention to provide an improved water barrier assembly with an elongated, flexible sweep or blade.

These and other objectives are achieved by providing a water barrier assembly for a shower door, including first and second sidewalls, a bottom wall joining the first and second sidewalls, interior surfaces of the bottom wall and the first and second sidewalls defining a channel adapted to receive a bottom portion of a shower door, a deflector extending outward from a top portion of the first sidewall, and a flexible blade extending from a bottom surface of the deflector and adjacent to an exterior surface of the first sidewall terminating with a distal end beyond a bottom surface of the bottom wall.

In some embodiments, at least a portion of the blade is curved between a proximal end and the distal of the blade in a direction toward the second sidewall. In some embodiments, less than half of a length of the blade extends beyond the bottom surface of the bottom wall. In some embodiments, the blade has a length greater than a length of the deflector.

The water barrier assembly may be a single extruded piece. In some embodiments, the first and second sidewalls, the bottom wall, and the blade are made of the same material. However, the blade may be made of a different material from the first and second sidewalls and the bottom wall, such as a flexible vinyl material. In some embodiments, the assembly is manufactured as a single integrated part using dual durometer extrusion.

Other objects of the present invention are achieved by provision of a shower door, including a door panel and a water barrier assembly mounted to a bottom edge of the door panel. The water barrier assembly includes first and second sidewalls and a bottom wall defining a channel receiving the bottom edge of the door panel. The water barrier assembly further including a flexible blade extending adjacent to an exterior surface of the first sidewall, the blade terminating below a bottom surface of the bottom wall.

Further provided is a water barrier assembly for a shower door including first and second sidewalls and a bottom wall joining the first and second sidewalls. Interior surfaces of the bottom wall and the first and second sidewalls define a channel adapted to receive a bottom portion of a shower door. A deflector extends outward from a top portion of the first sidewall, and a flexible blade extends from a bottom surface of the deflector and adjacent to an exterior surface of the first sidewall terminating with a distal end beyond a bottom surface of the bottom wall. At least a portion of the blade is curved between a proximal end and the distal of the blade in a direction toward the second sidewall. The proximal end of the blade has a thickness greater than the distal end of the blade. The blade also has a length greater than a length of the deflector.

Other objects of the invention and its particular features and advantages will become more apparent from consideration of the following drawings and accompanying detailed description.

DETAILED DESCRIPTION OF THE INVENTION

Figure 1:
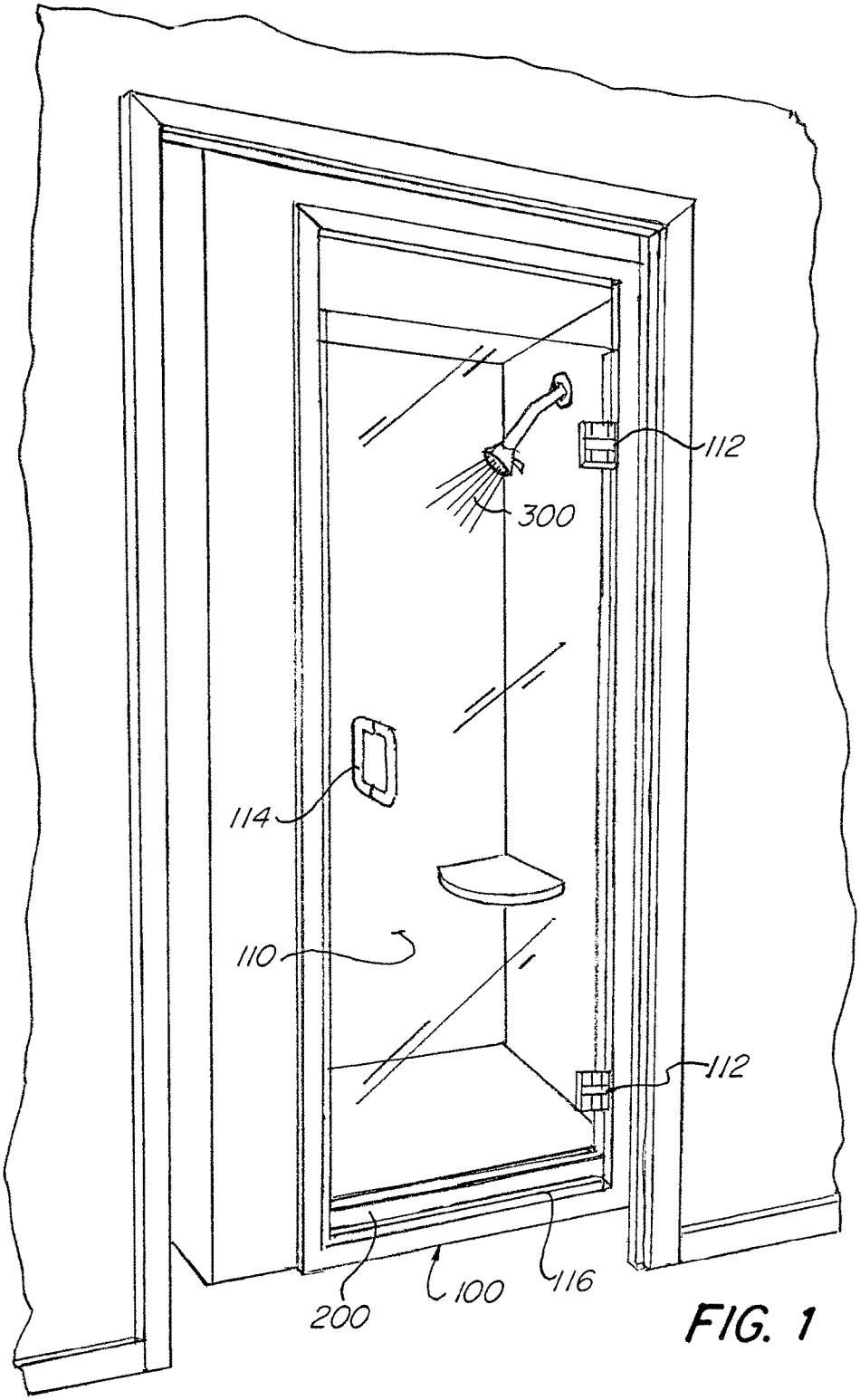
FIG. 1 is a perspective view of a shower including a shower door enclosure according to an exemplary embodiment of the present invention.

FIG. 1 illustrates a shower with a shower door enclosure 100 according to an exemplary embodiment of the present invention. The shower door 100 includes a glass panel 110 attached to the shower with two or more hinges 112. The shower door 100 further includes a handle 114. Below the shower door 100 is a threshold 116 over which the shower door 100 swings. The bottom of the glass panel 110 includes a water barrier assembly 200.

Figure 2:
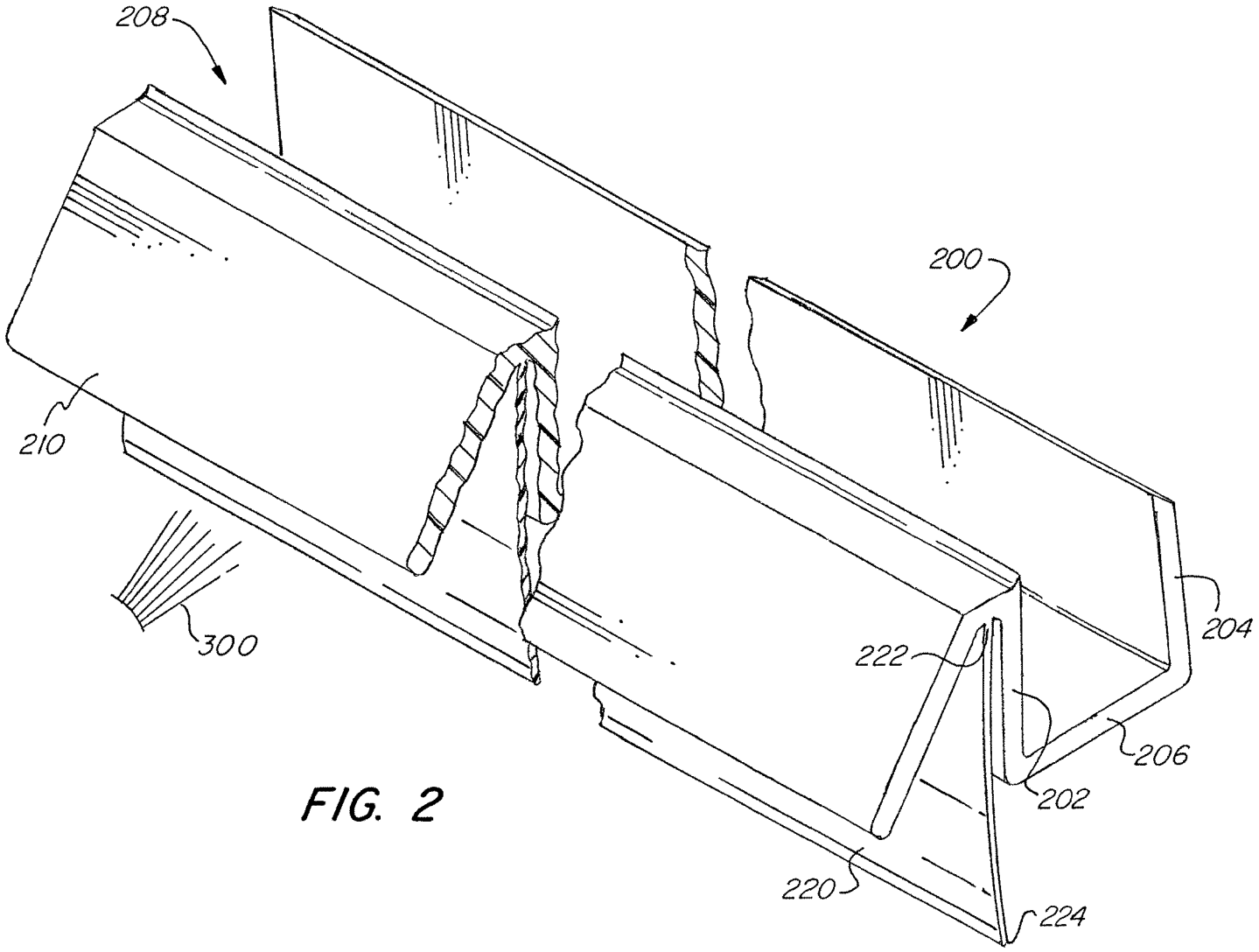
FIG. 2 is a water barrier assembly according to an exemplary embodiment of the present invention.
Figure 3:
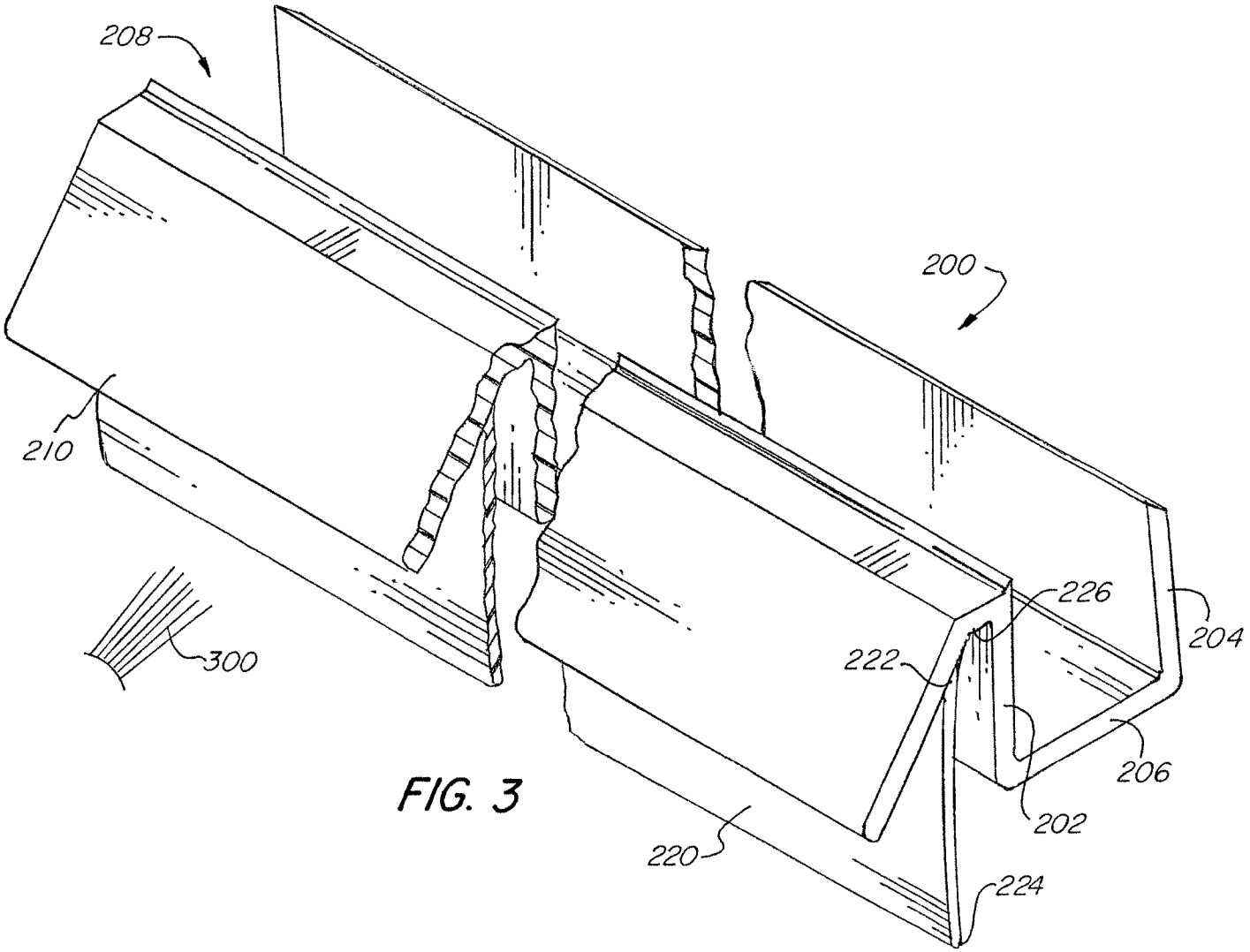
FIG. 3 is a water barrier assembly according to an exemplary embodiment of the present invention.

As shown in FIGS. 2 and 3, the water barrier assembly 200 includes a first sidewall 202, a second sidewall 204, and a bottom wall 206. A bottom surface of the bottom wall 226 may be substantially flat. Interior surfaces of the first and second sidewalls 202/204 and the bottom wall 206 define a channel 208 adapted to receive a bottom portion of a shower door 100. In some embodiments, the second sidewall 204 (or both the first and second sidewalls 202/204) is angled inward. In particular, the interior surface of the second sidewall 204 may be manufactured at an angle less than 90 degrees with respect to the bottom wall 206 (e.g., about 85 or 86 degrees). When attaching the assembly 200 to the bottom of the glass panel 110 of the shower door 100, the sidewall 204 provides a clamping force around the panel 110 due to its inward bias.

The water barrier assembly 200 further includes a deflector 210 extending outward (e.g., at a 45 degree angle) from a top portion of the first sidewall 202, and a flexible sweep 220 or blade. The deflector 210 deflects water spray 300 on the inside of the shower away from the door opening. The deflector 210 includes, or is connected to, a part extending substantially perpendicular to the top portion of the first sidewall 202. The sweep 220 extending, at its proximal end 222, from a bottom surface of the angled portion of the deflector 210 (as shown in FIG. 3) or from the horizontal portion of the deflector 210 (as shown in FIG. 2). The deflector 210 continues adjacent to an exterior surface of the first sidewall 202. At least a portion of the sweep 220 is curved between the proximal end 222 and a distal end 224 of the sweep 220 in a direction toward the first sidewall 202. There is also a gap 226 between the sweep 220 and the exterior surface of the first sidewall 202. The gap may extend at least half way up the first sidewall 202, and preferably at least two-thirds of the length of the first sidewall 202 or along substantially all of the length of the first sidewall 202.

In some embodiments, the sweep 202 has a length of approximately one inch or greater. The proximal end 222 of the sweep 220 may have a thickness greater than the distal end 224 of the sweep 220 (e.g., at least 0.025 inches at the proximal end 222 and 0.015 inches at the distal end 224). This provides for increased flexibility towards the distal end 224. The sweep 220 terminates with a distal end 224 beyond a bottom surface of the bottom wall 206 (e.g., about 0.5 inches below in some embodiments). Due to the curvature of the sweep 220, the distal end 224 may reside in line with or even inboard of the exterior surface of the first sidewall 202 in a non-deflected state.

The assembly 200 is generally extruded, though it can be manufactured by other means. In some embodiments, the first and second sidewalls 202/204, the bottom wall 206, and the blade 220 are comprised of a same material. However, the blade 220 is preferably made of a different softer material, such as a flexible vinyl, while the remaining portions of the assembly are made of a more rigid polycarbonate or other material. In such embodiments, the assembly 220 may be manufactured using dual durometer extrusion to co-extrude two materials having different physical properties.

Figure 4:
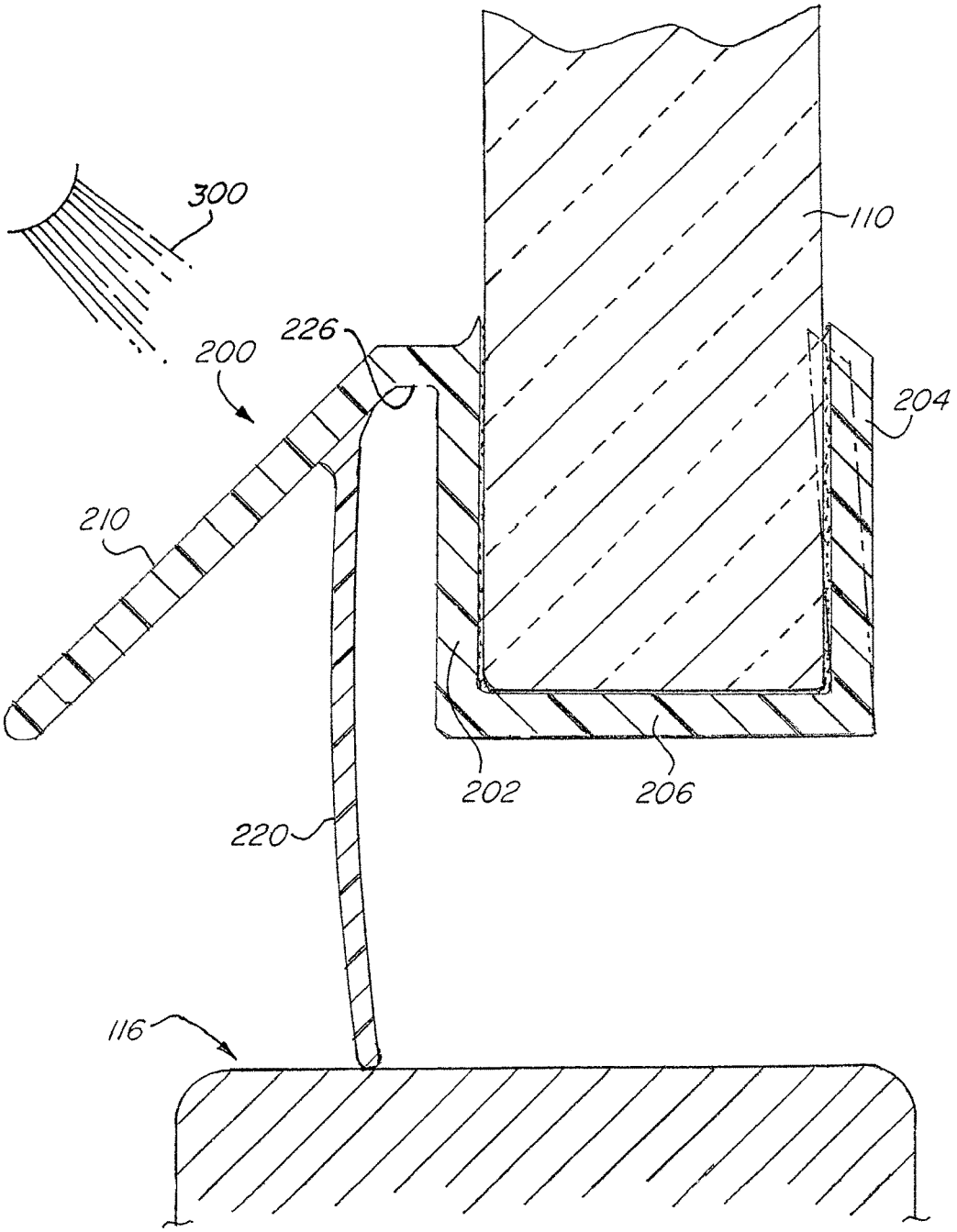
FIG. 4 is a water barrier assembly according to an exemplary embodiment of the present invention mounted on a shower door.

FIG. 4 illustrates the water barrier assembly 200 mounted on the glass panel 110 of the shower door 100. The assembly 200 may be mounted with adhesive or glue (e.g., on the bottom wall 206 and/or sidewalls 202/204), with mechanical attachments (e.g., screws through the bottom wall), or simply with the clamping force of the first and/or second sidewalls 202/204. The deflector 210 is positioned on the inside of the shower door 100 to deflect water 300 from the showerhead away from the bottom of the door 100. The sweep 220 provides a seal against the threshold 116 of the door. As the door opens and closes, the sweep 220 may bend as necessary to maintain contact and maintain a seal against the threshold to keep water from exiting the shower.

As shown in FIG. 4, the top edges of the first and second sidewalls 202/204 may be beveled or curved towards the glass panel 110. These edges, together with the tight fit of the assembly 200 due to the inward bias of the sidewall(s), assist with preventing water and debris from penetrating between the panel 110 and the assembly 200.

Figure 5:
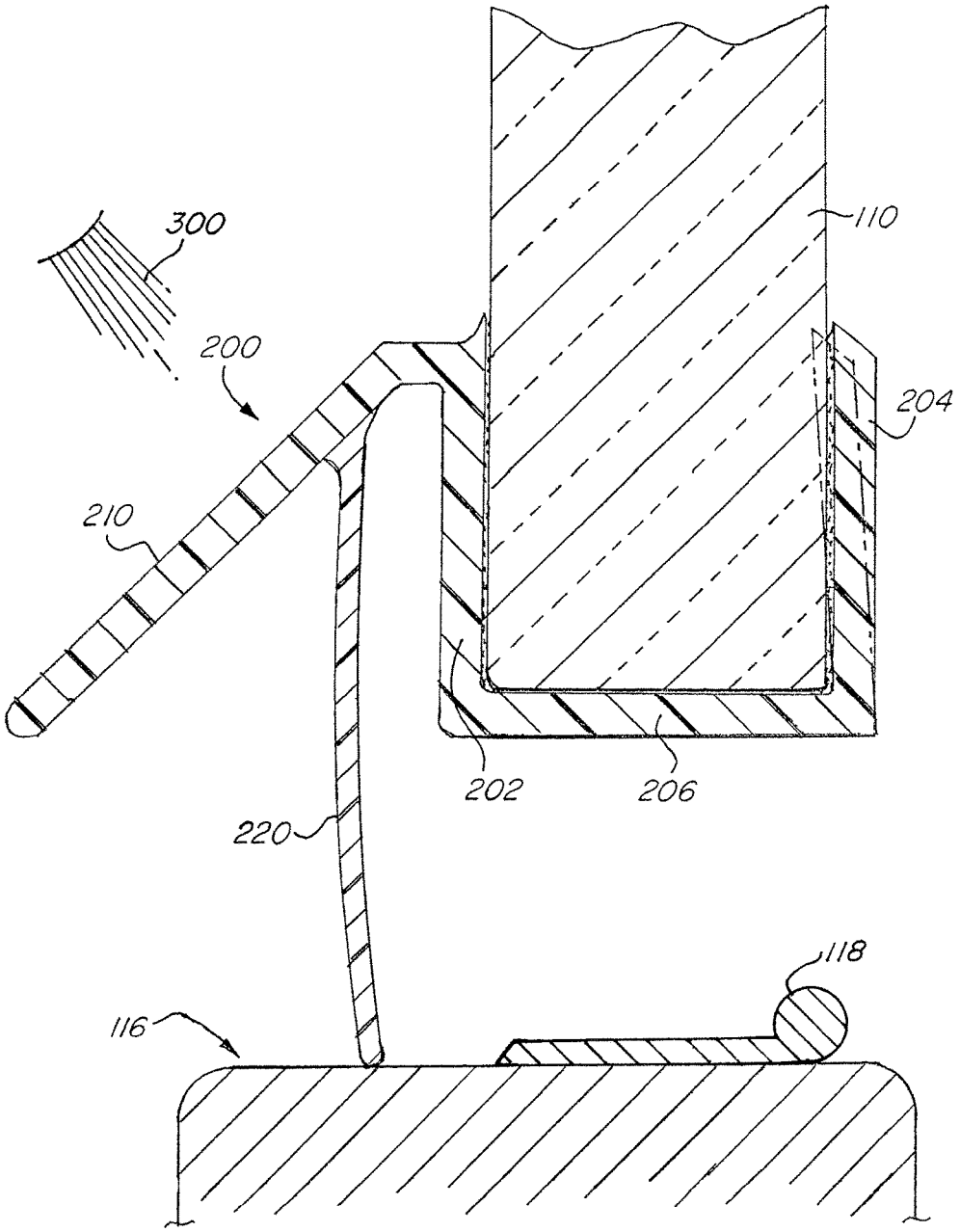
FIG. 5 is a water barrier assembly according to an exemplary embodiment of the present invention mounted on a shower door.

In some embodiments, the sweep 220 is in contact with and sweeps against the threshold directly as shown in FIG. 4. However, in some embodiments, a curb dam 118 is mounted to the threshold 116 to provide an additional water barrier as shown in FIG. 5. However, due the advantageous design of the present invention, a curb dam 118 is not necessary. The curb dam 118 may include a flat portion for attachment to the threshold and raised portion, such as a cylindrical rail.

Figure 6:
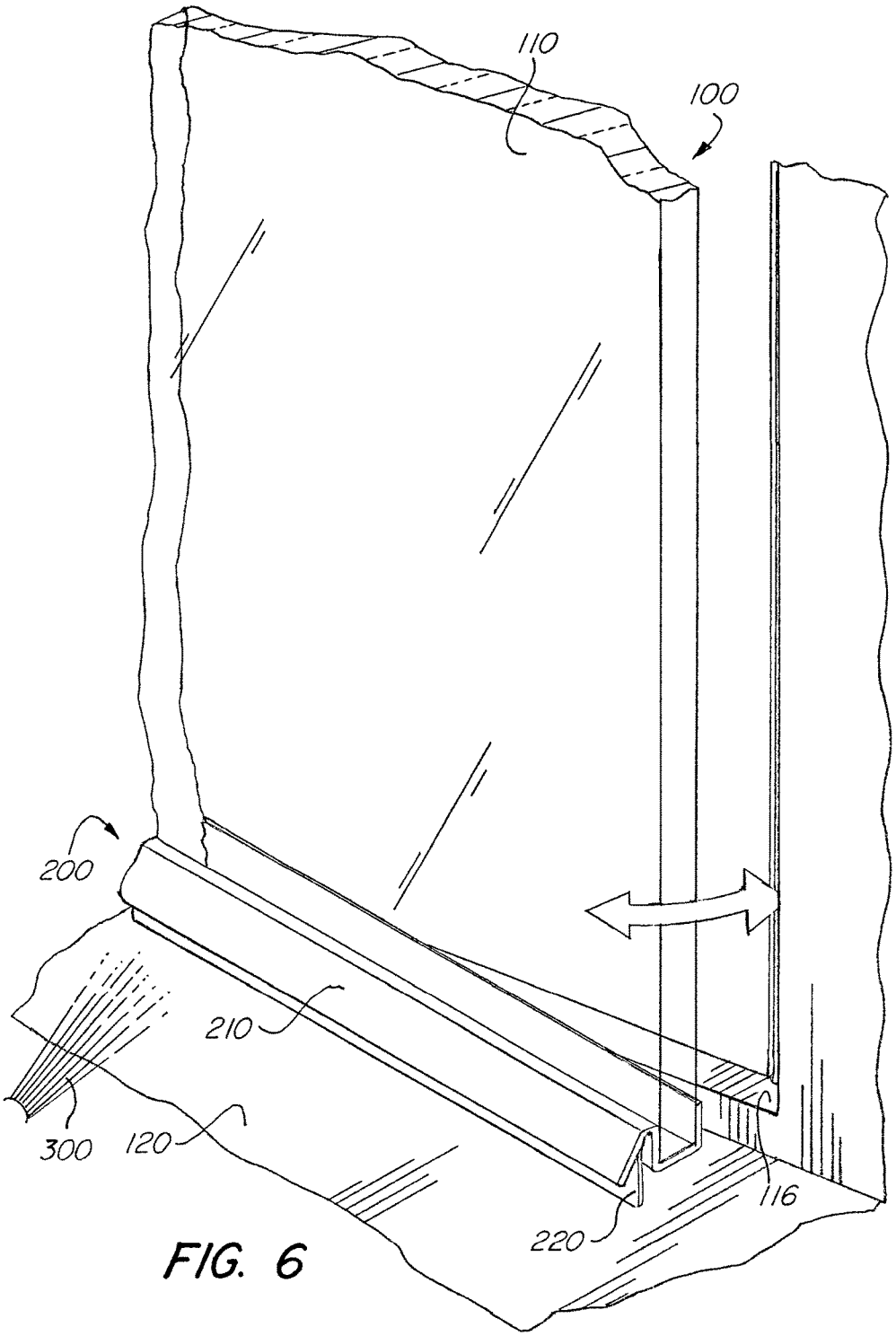
FIG. 6 is a cutaway view of a shower door enclosure according to an exemplary embodiment of the present invention.

FIG. 6 is a cutaway view of a shower door enclosure 100 according to an exemplary embodiment of the present invention. The door 100 swings through an opening above the threshold 116. In some embodiments, the door 100 may swing both inside the shower and outside. However, in other embodiments, the door 100 (or hinges 112 thereof) includes a stop to limit the range of the door 100. In the illustrated embodiment, the door is shown partially open over the interior floor 120 of the shower. The deflector 210 is on the inside of the shower door 100 to deflect water 300 from the showerhead away from the bottom of the door 100. As the door 110 is pushed closed, the sweep 220 comes into contact with the threshold 116 and creates a water barrier or seal.

Figure 7:
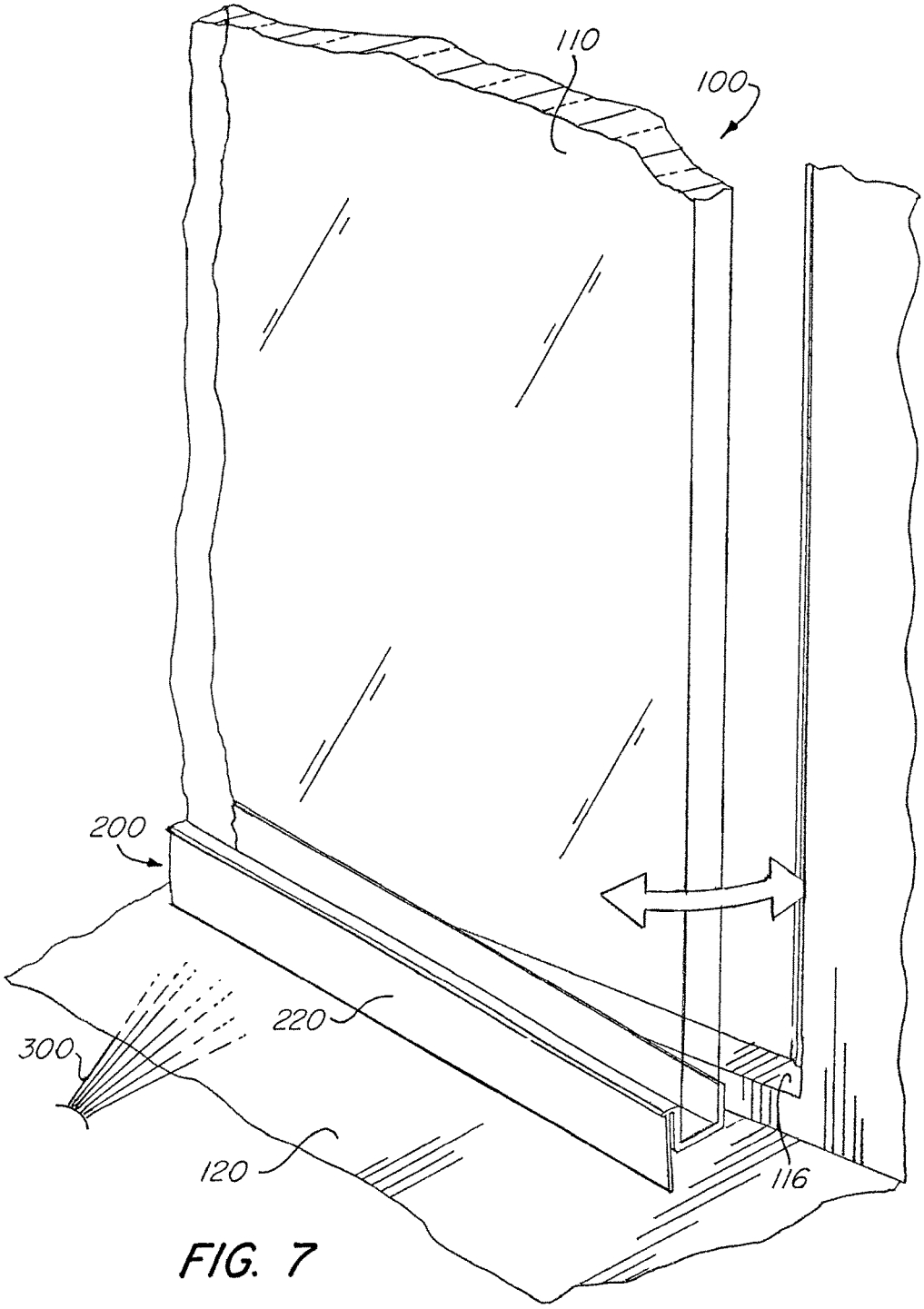
FIG. 7 is a cutaway view of a shower door enclosure according to an exemplary embodiment of the present invention.

FIG. 7 is another cutaway view of a shower door enclosure according to an exemplary embodiment of the present invention. As shown, the assembly 200 may be provided without the angled deflector 210 in some embodiments. The sweep 220, which is attached via a horizontal extender from the sidewall 202, creates the water barrier or seal as in the previous embodiments.

Although the invention has been described with reference to a particular arrangement of parts, features and the like, these are not intended to exhaust all possible arrangements or features, and indeed many modifications and variations will be ascertainable to those of skill in the art.

What is claimed is:

1. A water barrier assembly for a shower door, comprising:

first and second sidewalls, each having an interior surface and an oppositely facing exterior surface;

a bottom wall joining said first and second sidewalls, said bottom wall having an interior surface and a bottom surface, the interior surfaces of said bottom wall and said first and second sidewalls defining a channel adapted to receive a bottom portion of a shower door with a bottom edge of the shower door received adjacent to the interior surface of said bottom wall;

a deflector extending outward and downward at an angle from a top portion of said first sidewall; and a flexible blade having an exterior surface, an interior surface, and a proximal end attached to a bottom surface of said deflector at a position above said bottom wall, said flexible blade extending downward from the proximal end and along the exterior surface of said first sidewall defining a vertically elongated gap between the interior surface of said flexible blade and the exterior surface of said first sidewall, the gap extending uninterrupted from the bottom surface of said deflector to the bottom surface of said bottom wall allowing said flexible blade to flex about the proximal end towards and away from the exterior surface of said first sidewall, said flexible blade terminating with a distal end below the bottom surface of said bottom wall and said bottom surface of said bottom wall spaced apart vertically relative to a threshold of said shower door; and wherein said blade has a length greater than a length of said deflector such that the blade is long enough to contact an upper surface of said threshold while said deflector is spaced vertically from the upper surface of said threshold.

2. The water barrier assembly according to claim 1, wherein at least a portion of said blade is curved between the proximal end and the distal end of said blade in a direction toward said first sidewall.

3. The water barrier assembly according to claim 1, wherein the proximal end of said blade connected to said bottom surface has a thickness greater than the distal end of said blade.

4. The water barrier assembly according to claim 1, wherein said first and second sidewalls, said bottom wall, and said blade are comprised of a same material.

5. The water barrier assembly according to claim 1, wherein said blade is comprised of a material different than a material of said first and second sidewalls and said bottom wall.

6. The water barrier assembly according to claim 5, wherein said blade is a flexible vinyl material.

7. The water barrier assembly according to claim 5, wherein said first and second sidewalls, said bottom wall, and said blade are a single co-extruded part.

8. The water barrier assembly according to claim 1, wherein said second sidewall includes an at least partially beveled top edge.

9. The water barrier assembly according to claim 1, wherein less than half of a length of the blade extends beyond the bottom surface of the bottom wall.

10. The water barrier assembly according to claim 1, wherein the interior surface of said flexible blade is free of protrusions.

11. A shower door, comprising:

a door panel;

a water barrier assembly mounted to a bottom edge of said door panel;

said water barrier assembly including first and second sidewalls and a bottom wall defining a channel receiving said door panel with the bottom edge of said door panel adjacent to an interior surface of said bottom wall, the first and second sidewalls each having an interior surface and an oppositely facing exterior surface;

said water barrier assembly further including a flexible blade with an exterior surface and an interior surface, the flexible blade beginning at a proximal end positioned above the bottom edge of said door panel and extending along the exterior surface of the first sidewall defining a vertically elongated gap between the interior surface of the flexible blade and the exterior surface of the first sidewall, the gap extending uninterrupted from the proximal end to a bottom surface of said bottom wall allowing the blade to flex about the proximal end towards and away from the exterior surface of the first sidewall, the blade terminating below a bottom surface of the bottom wall and said bottom surface of said bottom wall spaced apart vertically relative to a threshold of said shower door;

a deflector connected to a top edge of the first sidewall, the blade extending from a bottom surface of the deflector; and wherein said blade has a length greater than a length of said deflector such that the blade is long enough to contact an upper surface of said threshold while said deflector is spaced vertically from the upper surface of said threshold.

12. The shower door according to claim 11, wherein said door panel is comprised of glass.

13. The shower door according to claim 11, wherein a proximal end of the blade has a thickness greater than a distal end of the blade.

14. The shower door according to claim 11, wherein less than half of a length of the blade extends below the bottom surface of the bottom wall.

15. The shower door according to claim 11, wherein at least a portion of the blade is curved between a proximal end and a distal end of said blade in a direction toward the first sidewall.

16. The shower door according to claim 11, wherein the bottom surface of the bottom wall is flat.

17. A water barrier assembly for a shower door, comprising:

first and second sidewalls, each having an interior surface and an oppositely facing exterior surface;

a bottom wall joining said first and second sidewalls, said bottom wall having an interior surface and a bottom surface, the interior surfaces of said bottom wall and said first and second sidewalls defining a channel adapted to receive a bottom portion of a shower door with a bottom edge of the shower door received adjacent to the interior surface of said bottom wall;

a deflector extending outward and downward at an angle from a top portion of said first sidewall terminating with a distal tip below the interior surface of said bottom wall; and a flexible blade having an exterior surface, an interior surface, and a proximal end attached to a bottom surface of said deflector at a position above said bottom wall, said flexible blade extending downward from the proximal end and along the exterior surface of said first sidewall, defining a vertically elongated gap between the interior surface of the flexible blade and the exterior surface of said first sidewall, and terminating with a distal end beyond the bottom surface of said bottom wall, the gap extending uninterrupted from the bottom surface of said deflector to the bottom surface of said bottom wall allowing said flexible blade to flex about the proximal end towards and away from the exterior surface of said first sidewall, at least a portion of said blade being curved between the proximal end and the distal end of said blade in a direction toward said second sidewall and the proximal end of said blade having a thickness greater than the distal end of said blade;

wherein said bottom surface of said bottom wall spaced apart vertically relative to a threshold of said shower door; and wherein said blade has a length greater than a length of said deflector such that the blade is long enough to contact an upper surface of said threshold while said deflector is spaced vertically from the upper surface of said threshold.

* * * * *